United States Patent [19]

Martin et al.

[11] Patent Number: 4,999,616

[45] Date of Patent: Mar. 12, 1991

[54] DEVICE AND METHOD FOR RECOGNIZING THE INSTANTANEOUS POSITION OF MECHANICAL PARTS DRIVEN BY A STEPPING MOTOR

[75] Inventors: Claude Martin, rue Voltaire; Francis Chevillon, rue Saint-Vincent-de-Paul, both of France

[73] Assignee: SECAP, Boulogne, France

[21] Appl. No.: 502,227

[22] Filed: Mar. 30, 1990

[30] Foreign Application Priority Data

Mar. 30, 1989 [FR] France ..... 89 04140

[51] Int. Cl.[5] ..... G08B 21/00

[52] U.S. Cl. ..... 340/674; 250/222.1; 340/555; 340/679

[58] Field of Search ..... 340/679, 686, 674, 572, 340/555, 600, 542-543, 825.31-825.32, 426, 430; 307/10.5; 361/171-173, 177; 180/287, 289; 250/222.1, 223 R; 425/138, 169

[56] References Cited

U.S. PATENT DOCUMENTS

| | | | |
|---|---|---|---|
| 3,530,341 | 9/1970 | Hutchinson | 361/177 |
| 3,818,190 | 6/1974 | Silverman et al. | 340/825.31 X |
| 4,090,063 | 5/1978 | Martin | 235/92 AC |
| 4,180,856 | 12/1979 | Check, Jr. et al. | 364/466 |
| 4,224,603 | 9/1980 | Lallemand | 340/347 P |
| 4,251,059 | 2/1981 | Fougea | 340/677 X |
| 4,268,746 | 5/1981 | Schroeder | 250/223 R |
| 4,288,780 | 9/1981 | Theodoru et al. | 340/825.31 X |
| 4,412,798 | 11/1983 | Avellino et al. | 250/222.1 X |
| 4,603,329 | 7/1986 | Bangerter et al. | 340/679 |
| 4,665,392 | 5/1987 | Koontz | 340/674 |
| 4,723,486 | 2/1988 | Le Meur et al. | 101/91 |
| 4,851,663 | 7/1989 | Denzin et al. | 250/223 R |
| 4,886,566 | 12/1989 | Peyre | 250/223 R X |

FOREIGN PATENT DOCUMENTS

| | | |
|---|---|---|
| 2354592 | 1/1978 | France . |
| 386454 | 4/1965 | Switzerland . |
| 2159941 | 12/1985 | United Kingdom . |
| 2194842 | 3/1988 | United Kingdom . |

OTHER PUBLICATIONS

Arrabito et al., "Security Lock Actuating System", IBM Tech. Discl. Bulletin, vol. 12, No. 9, Feb. 1970.

*Primary Examiner*—Glen R. Swann, III
*Assistant Examiner*—Thomas J. Mullen, Jr.
*Attorney, Agent, or Firm*—Foley & Lardner, Schwartz, Jeffery, Schwaab, Mack, Blumenthal & Evans

[57] ABSTRACT

The invention includes a device and a method for recognizing the instantaneous position of a plurality of mechanical parts, the parts being linearly and incrementally movable between a departure position and an arrival position. The device includes a plurality of radiation modifying tags respectively associated and movable with the mechanical parts. There are a plurality of pairs of radiation emitters and receivers located on the opposite sides of the parts at incremental positions, whereby the pressence of a tag between a given pair causes modification of the radiation received by an associated receiver. The device further provides for generating detect signals from the receivers, and for recognizing that corroborating detect signals from the receivers correspond to a specific set of positions of the mechanical parts.

9 Claims, 3 Drawing Sheets

DEVICE AND METHOD FOR RECOGNIZING THE INSTANTANEOUS POSITION OF MECHANICAL PARTS DRIVEN BY A STEPPING MOTOR

BACKGROUND OF THE INVENTION (1) Domain of the Invention

The invention relates, in a general manner, to the recognition of the instantaneous position of several mechanical parts capable of being displaced linearly by increments by means of a stepping motor.

More particularly, the invention relates, very specifically, to franking machines, which comprise value placing racks, arranged on the printing drum.

It is important to ensure that the actual position of the racks, on which the printed value will depend, is indeed the chosen position.

(2) Prior Art

In the case of franking machines where the value placing is carried out manually with the aid of thumb wheels (cf. the document U.S. Pat. No. 4,090,063), the risk of error is not high; this recognition problem can be resolved with the aid of magnetic sensors surrounding the printing drum or its shaft and effecting the detection during a revolution of the said drum; the printing order is not validated unless the recognition is positive.

In the more sophisticated franking machines of the type which the document U.S. Pat. No. 4,723,486 describes, the teaching of which is included here by reference, the value setting is carried out with the aid of a keyboard. It is then necessary to have an interface between the keyboard and the racks; this interface consists of a stepping motor allowing choice of the rack (selection) and its mechanical translation to a position dependent on the digit, from 0 to 9, chosen at the keyboard for the decade concerned (indexing).

In such a machine, where more relatively indefinite elements take part in the chain linking the placing of the new value by the operator and the positions actually taken by the racks, the problem of a recognition, of a verification of the positions of the racks arises with increased insistence. Moreover, the probability of an incident makes it desirable to carry out this recognition with minimal delay after the value setting and, in any case, before the setting in rotation of the printing drum. Because of this, in a machine of this type it is not possible to use simple magnetic sensors whose detection principle is generally based on the displacement of the objects to be detected In the document U.S. Pat. No. 4,224,603 an effective absolute registering of the racks has been proposed. However, this registering requires, for each rack, the presence of several proximity sensors, adjacent to the rack concerned. The sensors and their cabling as a whole thus occupy a not insignificant space above the racks, which space it would be pleasing to be able to reduce.

Furthermore, by virtue of the document GB-A No. 2,194,842, a device allowing the registering of a single rack by virtue of a set of slits placed in the path of two luminous beams is known. Since two beam emitters and two beam receivers are necessarily required on either side of the rack concerned, it can be imagined that the adaptation of such a system to a four rack machine, as is most often the case, will take up a large volume, either in width or in height, according to the device adopted.

Finally, we point out as a reminder the document CH-A No. 386,454 which relates, not to the position recognition of linear displacement parts, but to that of pivoting parts such as typewriter keyboard keys. The recognition system is based on the occultation of a plurality of parallel beams by a coded screen, when a key is depressed. Such a system allows the recognition of the position of only one key at a time, and cannot be adapted to the recognition of the position of adjacent racks with linear displacement which would simultaneously occult the plurality of beams and would distort the recognition of the coded screens.

SUMMARY OF THE INVENTION

The aim of the invention is thus to propose a new method and device for recognition, free from the above-mentioned disadvantages and specially adapted to a franking machine of the type under consideration.

The invention attains its aim by proposing a device for recognizing the instantaneous positions of several adjacent mechanical parts capable of being displaced linearly by increments by means of a stepping motor between a departure position and an arrival position, which comprises:

radiation modifying tags individually linked to each of the mechanical parts, and capable of occupying a plurality of tag positions, associated with the various possible positions of the parts, a collection of pairs of means which are respectively emitters and receivers of radiation, distributed on either side of the plurality of the tag positions in such a way that the presence of a tag in the path of the radiation emitted by a given emitter and directed at its associated receiver causes a modification of the radiation detectable by the said receiver, which then provides a detect signal, means for recognizing that corroborating detect signals provided by the collection of receivers correspond to a predetermined set of positions of the mechanical parts.

Thus, the invention proposes a static optical sensor of the position of the mechanical parts.

"Modifying tag" is understood to be a unit capable of interposing itself, at the time of a displacement of the mechanical part to which it is linked, in the beam of radiation emitted from a given emitter and directed towards its associated receiver, and of modifying, in a detectable way, the radiation received at the receiver. Generally, the tags will simply be opaque, so that the observed modification will be an absence of radiation. The tags could equally be reflectors; it will thus be understood that the arrangement of the emitters and of the receivers "on either side of" the tag positions should not be interpreted in a strictly geometric way, but rather is based on the notion of path of beam before and after its incidence on the tag.

The radiation employed will advantageously be a luminous radiation emitted, for example, by luminescent diodes.

There are at least as many emitter-receiver pairs as there are tag positions to be recognized for a given mobile mechanical part.

For the plurality of mobile parts, the arrangement of as many emitter-receiver pairs as there are tag positions for all the mobile parts could be envisaged, the whole being laid out so as to establish an unequivocal correspondence between a global indication of the receivers at a given moment and the instantaneous position of the tags (and thus of the mobile parts) at this precise moment.

But according to a preferred characteristic of the invention, the parts and the tags are, on the contrary, arranged in such a way that the tags of several of the parts can be located in a single path of radiation emitted by a given receiver (sic) and directed at its associated receiver In a further preferred embodiment, particularly well suited to franking machines (the mobile parts then being the value setting racks), the tags of all the parts are aligned in the same radiation path, each time that the parts are in analogous positions. Such an arrangment allows a considerable space saving at the level of the intermediate environment of the printing drum.

However, according to this arrangement, the correspondence between the global indication given by the receivers, and the actual position of the racks is no longer unequivocal: two different positions of the collection of the mobile parts can, in certain configurations, give a same reading by the optical sensor.

This is why in the cases where such an ambiguity could constitute a handicap, and this is indeed the case of franking machines, the device of the invention incorporates means of checking of the recognition carried out.

The principle of these means is that recognitions are carried out in intermediate positions between the departure and arrival positions. It will be understood that the more intermediate recognitions that are carried out, the less is the risk that all these checks relate explicitly to ambiguous situations and that a malfunction remains unnoticed after several checks.

It is possible to provide for a recognition to be carried out for each of the intermediate positions taken by the mobile parts, and for this recognition to be effected, part after part.

For additional security, the means of checking further include means for checking the stepwise advance of the motor, at least in packets of a predetermined number of steps.

According to an important characteristic of the invention, means for initializing the mechanical parts at a reference position are provided, which means act in response to a negative check carried out by the means of checking. The operation of displacement of the parts towards the arrival position can then resume from this reference position for which it was known how to reestablish the agreement between actual position and position read by the optical sensor.

The invention further relates to a method of recognition associated with the above mentioned device.

The method of the invention comprises the steps consisting in:

linking radiation modifying tags individually to each of the mechanical parts, these tags being capable of occupying a plurality of tag positions, associated with the various possible positions of the parts, arranging a collection of pairs of means which are respectively emitters and receivers of radiation, distributed on either side of the plurality of the tag positions in such a way that the presence of a tag in the path of the radiation emitted by a given emitter and directed at its associated receiver causes a modification of the radiation detectable by the said receiver, which then provides a detect signal, recognizing that corroborating detect signals provided by the collection of receivers correspond to a specific set of positions of the mechanical parts.

Advantageously, the arrival position as well as intermediate positions between the departure and arrival position (sic) are recognized, and in the event of a failure in the recognition, the mechanical parts are initialized to a reference position.

The various means of recognition and of checking include appropriate software managing the various operations which will be described in greater detail below, the realization of such software, according to the indications given above and below, being within the immediate capability of those skilled in the art.

BRIEF DESCRIPTION OF THE DRAWINGS

Other characteristics and advantages of the invention will emerge from the description which follows of an embodiment of the invention. Reference will be made to the attached drawings in which.

DESCRIPTION OF THE PREFERRED EMBODIMENT

Figure 1:
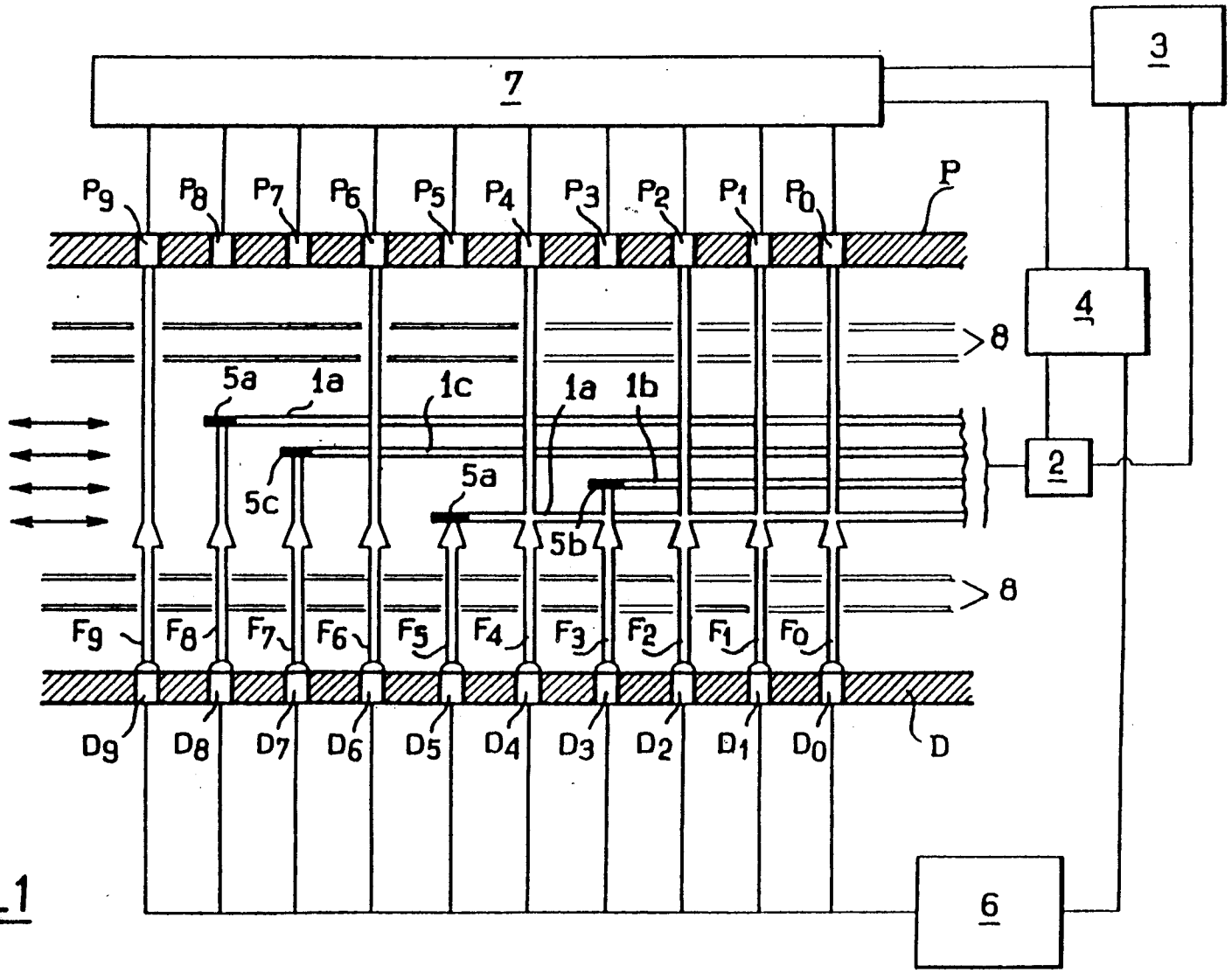
FIG. 1 is a diagram of a cast shadow optical sensor according to the invention.

In FIG. 1 are seen four adjacent longitudinal rods 1*a*, 1*b*, 1*c*, 1*d* carrying racks, by virtue of which they can be engaged by at least one toothed wheel, belonging to a value setting device 2.

These rods further carry racks engaging with the obliterator printing thumbwheels.

The value setting device 2 comprises means, acting in response to the display of a value on the keyboard 3, for the toothed wheel successively to select the rods 1 to be displaced, then, after each rod 1 selection, to index the latter to a position corresponding to the chosen digit from 0 to 9 by a translation movement of the rod consequent upon a rotation of the toothed wheel. A stepping motor 4 drives the toothed wheel in its selection and indexing movements.

All the above belongs to the state of the art represented by the document U.S. Pat. No. 4,723,486 and will not be described in further detail.

According to the invention, the position of the rods 1 (and hence of the associated racks) is registered by virtue of a cast shadow optical sensor provided in the region of the free ends of the rods.

To this end, the rods 1*a*, 1*b*, 1*c*, 1*d* carry, at their end, a tag 5*a*, 5*b*, 5*c*, 5*d*, opaque to the luminous rays, slightly offset (upwards or downwards) from the level of the four rods.

Furthermore, an array D of emitting diodes $D_0$ to $D_9$ supplied by a suitable source 6, and an array of phototransistors $P_0$ to $P_9$ are arranged respectively on either side of the collection of rods 1, at the level of the said tags 5. Each segment $D_iP_i$, where i is between 0 and 9, is orthogonal to the rods 1, and corresponds to one of the possible positions of the rods 1.

The diodes $D_i$ emit luminous beams $F_i$ directed towards the bases of the phototransistors $P_i$ opposite. Diaphragms 8 collimate the beams $F_i$ in order to avoid spurious rays and specular reflections If no tag 5 intercepts the beam $F_i$, the latter excites the base of the phototransistor $P_i$. On the contrary, if a tag interposes itself in the way of the beam $F_i$ the phototransistor $P_i$ is not illuminated.

An electronic block 7 receives the signals of the phototransistors $P_i$ and can, by the detection of the coupled beams, check the value $V_dV_cV_bV_a$, corresponding to the position of the rods 1.

Thus in FIG. 1, where the tags 5a, 5b, 5c, 5d occult the beams $F_5$, $F_3$, $F_7$, $F_8$, the value to be read is 8735.

The optical sensor of the invention thus allows simple checking of the position of the rack rods to ensure that the actual position indeed corresponds to the desired value.

However, while the sensor of the invention gives the greatest satisfaction as regards simplicity of operation, robustness and compactness (allowing housing on the principle shaft of the franking machine), it allows a global reading ambiguity to remain, insofar as the rod whose tag will intercept a given beam is not determined. A global reading does not distinguish the value 8735 from 8537.

To avoid this, it is expedient to read and check the movement of the rack rods one by one: but even then, there remain cases of ambiguous reading, in particular when the old or new values comprise two or three identical digits. Thus, the passage from a value 3321 to 2321 does not give a different global reading: an operating defect of the rod 1d thus risks not being detected.

This is why the optical sensor of the invention is accompanied by software for reading and meticulous checking allowing palliation of these possible ambiguities.

The exact sequences of a value setting operation will be explained below, within the framework of the optical sensor of the invention adapted to a device in accordance with the teaching of the document U.S. Pat. No. 4,723,486: in particular, the selection of a rack is carried out with the aid of a stepping motor (motor 18 of the abovementioned document), then by activation of an electromagnet (electromagnet 55 of the abovementioned document) in order to engage a driving element by the selected rack. The indexing of the selected rack is then carried out by virtue of the stepping motor.

In order to fix the ideas, the following constructive hypotheses will be retained.

The stepping motor selected is of the type in which the torque is inversely proportional to the speed, and where the step n is not executed unless the step of order n−1 has been carried out.

The stepping motor makes one revolution in 100 steps. A 10 slit coder disk is fixed rigidly on its driving shaft, thus allowing counting of packets of 10 steps.

Moreover, it will be supposed that a packet of 10 steps is required to select a rack, and a packet of +10 steps (respectively −10 steps) to index the selected rack from a digit n to n+1 (respectively n−1).

Finally, it is specified that two end-of-travel cells check the action of the electromagnet for the engaging or the disengaging of the selected rack.

This being the case, the general principle of the setting to new values is the following.

Let $V_{d1}$ $V_{c1}$ $V_{b1}$ $V_{a2}$ be the old value and $V_{d2}$ $V_{c2}$ $V_{b2}$ $V_{a1}$ be the new value.

Call $R_a=V_{a1}-V_{a2}$ $R_b=V_{b1}-V_{b2}$ $R_c=V_{c1}-V_{c2}$ $R_d=V_{d1}-V_{d2}$ that is to say the differences between the digits of the same order of the two values.

Figure 2:
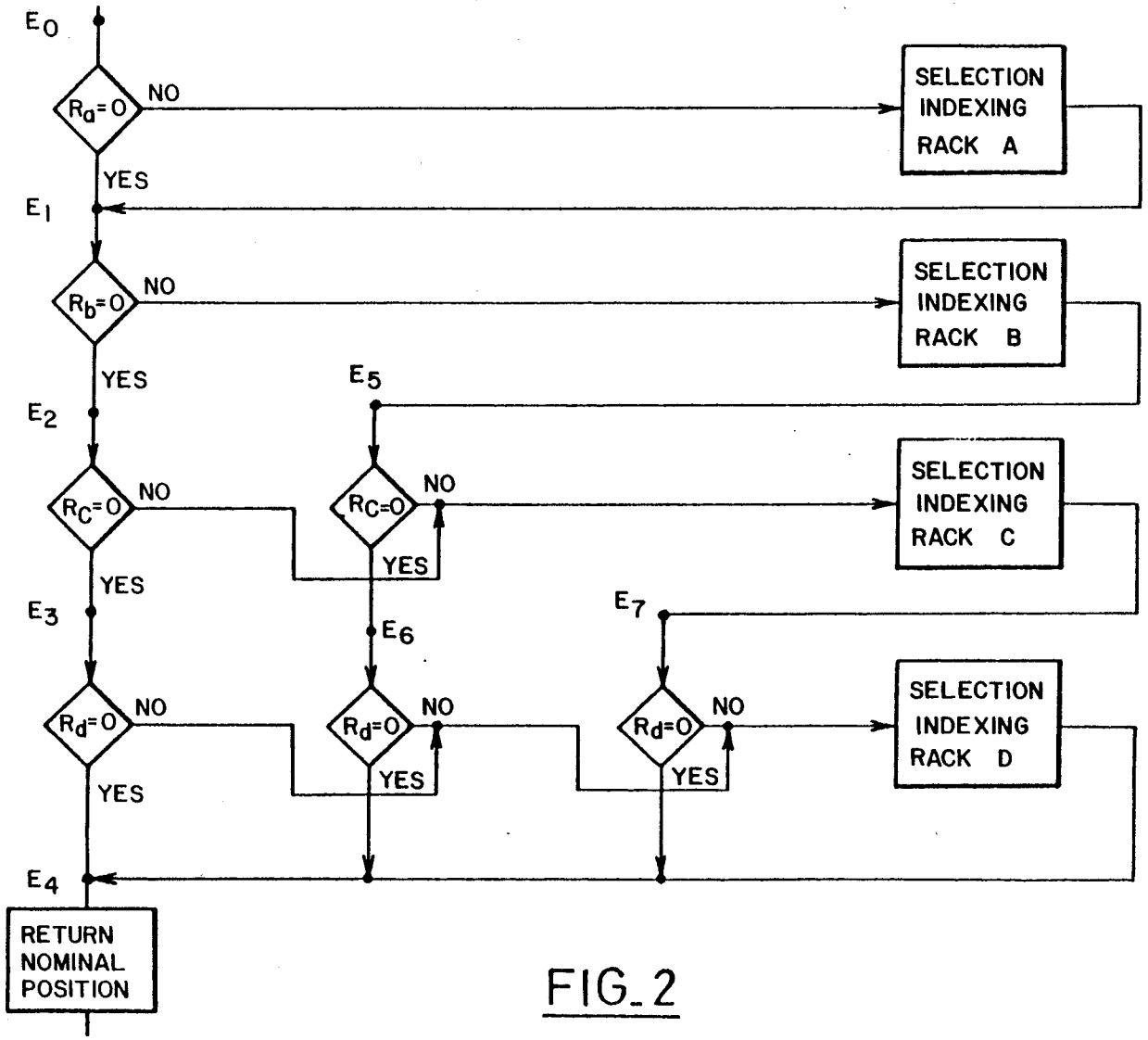
FIG. 2 is a general flow diagram showing the principle of the setting of values.

The general flow diagram in FIG. 2 shows the principle of successive positioning of the four racks 1a, 1b, 1c, 1d, as a function of the values $R_a$, $R_b$, $R_c$, $R_d$.

The principle can be summarized thus: the value $R_i$ is tested. If it is zero, then the digit of order i of the new value is the same as in the old value; stage i+1 is then proceeded to directly. If on the contrary, $P_i$ (sic) is not zero, the rack of order i is selected and is indexed to the new value. Then stage i+1 is then (sic) proceeded to.

Figure 3:
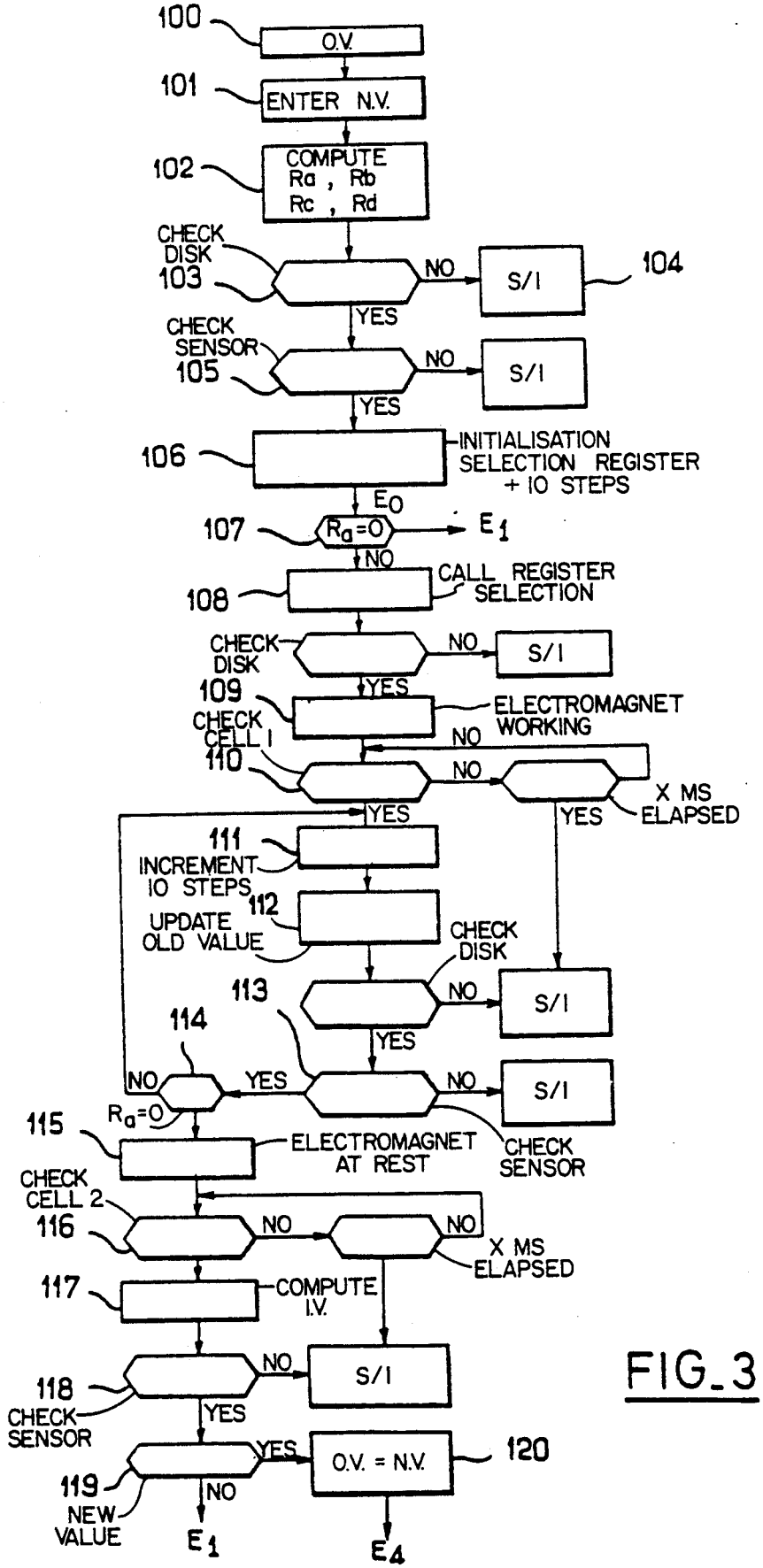
FIG. 3 is a detailed flow diagram accurately showing the first sequences of a value setting operation.

FIG. 3 details the operations executed at the start of the program and the positioning of the first rack, it being understood that the positioning of the subsequent racks is carried out in a very similar way.

The old value (O.V.) is assumed recorded in memory (100) and the new value (N.V.) is entered (step 101). The differences R are then computed (step 102).

A first check of the coder disk of the shaft of the motor is proceeded to (step 103). If no slit is registered, the procedure is stopped and an initialization of the machine (step 104 =stop/initialization S/I) is returned to. If the check is positive, the optical sensor which has to read the old value still in place is checked (step 105). If this is not the case, a S/I step is proceeded to. If the check is positive, a selection register is initialized to a value of +10 steps (step 106) and phase $E_0$ of the program is entered.

This phase $E_0$ begins with a test (step 107) on the value of $R_a$; if it is zero, phase $E_1$ is proceeded to. If not, the call to the selection register (step 108) allows selection of the rod 1a, by virtue of the advance of 10 steps. After a new check of the coder disk, the electromagnet controlling the engaging of the rack is placed in working position (step 109), which position is checked by a first end-of-travel cell (step 110): if the positioning is not completed at the end of a set time, for example 10 ms, a S/I command is generated.

When the electromagnet is in place, the selected rack 1a is indexed by an increment of 10 steps (step 111), then the old value is updated (step 112) to an intermediate value $V_{d1}$ $V_{c1}$ $V_{b1}$ $V_{a'1}$, where $V_{a'1}$ differs in one unit from the previously recorded digit (in order to correspond to the value designated by the rack incremented by 10 steps). After a new check of the coder disk, a check of the optical sensor, which has to read a value corresponding to the new updated value is carried out (step 113). A new computation of $R_a$, updated, is made, and a test 114 on the updated value of $R_a$ allows renewal of the incrementation provided a zero difference is not obtained. When a zero difference is obtained, the electromagnet is deactivated (step 115) with a check loop 116 analogous to the check 110 (but with the aid of a second end-of-travel cell). The new intermediate value I.V.$=V_{d1}$ $V_{c1}$ $V_{b1}$ $V_{a2}$ is computed (step 117) and is checked by the optical sensor (step 118). If the check is positive, this value is compared to the new O.V.; if they are identical, the value setting is finished, the old value O.V. can be replaced in memory by the new value N.V. (step 120) and the final phase $E_4$ can be proceeded to. If they are different, phase $E_1$ of selection and indexing of the subsequent rack is proceeded to.

The subsequent phases essentially repeat the operations described above, for each rack concerned.

Through the frequency and placement of the tests provided, the chosen program for value setting ensures that, despite the possible reading ambiguities of the optical sensor of the invention, the value setting can be carried out without error.

An original feature of the chosen program is the systematic recourse to stoppage and to a new initialization in the event of malfunctioning appearing during the value setting program (errors detected by the coder disk or the optical sensor).

An initialization must, of course, also occur in the powering-up of the machine.

The procedure chosen for the initialization in accordance with the invention is the following.

The hypothesis is made that neither the position of the slits of the integral coder disk of the shaft of the stepping motor, nor the position of the tags of the racks is known. In other words, the cell of the disk is occulted and all the tags are in intermediate position between the emitters and receivers of the optical sensor.

The concept chosen is to set all the tags in position 0000 in a certain manner.

Through software, the speed of the motor is first reduced in order to confer upon it a maximum torque allowing it to overcome the possible resistances to the hard points encountered, which can be the cause of the malfunctioning found (for example, dried ink, etc).

Next, the first slit of the coder disk is sought. −40 steps are then carried out. Thus, whatever the position of the selection carriage, the number of steps is greater than or equal to the number necessary for the return to the departure position; the carriage is sure to be in "selection departure" position and to be synchronous with the slits of the coder disk (it is recalled that, by constructive hypothesis, there is a slit every ten steps and that it requires 100 steps to carry out a complete rotation).

By a packet of +10 steps the first rack 1*a* is selected. It is indexed to the value 9 by a packet of +90 steps. Thus, whatever be the actual index of the rack 5*a*, it is certain to run up on a stop which has been tested. A test is made to see if the rack is simultaneously opposite a slit of the coder disk. If the two tests are positive, the rack 5*a* is indexed to the value 0 by a rotation of −90 steps of the stepping motor.

After selection of the rack 1*b* (+10 steps), the procedure is restarted until the rack 1*d* has been selected.

The selection carriage is reset in departure position and, with the aid of the optical sensor, the value read is tested to see if it is indeed 0000.

In the contrary case, which signifies that the malfunctioning has persisted, the initialization procedure is restarted five times. If the five attempts are unsuccessful, it can be assumed that there has been a fatal breakdown, which the initialization procedure cannot remedy.

Of course, numerous modifications are possible without exceeding the scope of the invention. Thus, the ten slit coder disk of the driving shaft can be replaced by two Hall effect probes prepositioned in the motor and delivering signals in quadrature. This means allows counting of the steps by observation of the rising and falling fronts of the signals of the probes.

We claim:

1. A device for recognizing the instantaneous position of a plurality of mechanical parts, the parts being capable of being linearly and incrementally displaced between a departure position and an arrival position, comprising:

(a) a plurality of radiation modifying tags respectively associated with said parts, said tags being movable to a plurality of tag positions corresponding to the incremental parts positions;

(b) a plurality of pairs of radiation emitting means and radiation receiving means, said pairs of means being located at incremental parts positions, an emitting means of each said pair being on one side of a position and a receiving means of said pair being on another side of said position, whereby the presence of a tag between one of said pairs of emitting and radiation receiving means causes a modification of radiation detectable by an associated receiving means;

(c) means for providing detect signals from said receiving means; and (d) means for recognizing that corroborating detect signals provided by said receiving means correspond to a specific set of positions of said parts.

2. A device according to claim 1, wherein said parts and said tags are arranged such that tags of certain of said parts are located in a single radiation path between a pair of said emitting means and receiving means.

3. A device according to claim 2, wherein the tags of all of said parts are aligned in the same radiation path each time said parts are in analogous positions.

4. A device according to claim 1, further comprising means for checking said recognizing means.

5. A device according to claim 4, wherein said checking means comprises means for carrying out recognitions in intermediate positions between the departure position and the arrival position.

6. A device according to claim 4, including means for initializing said parts at a reference position, said initializing means acting in response to a negative check provided by said checking means.

7. A device according to claim 1, including stepping motor means for incrementally moving said parts.

8. A device according to claim 7, including means for checking the recognizing means, said checking means including means for checking the stepwise advance of said motor means.

9. A device according to claim 1, wherein said parts are rods connected to indexing racks.

* * * * *